US010161652B2

(12) United States Patent
Morishita

(10) Patent No.: US 10,161,652 B2
(45) Date of Patent: Dec. 25, 2018

(54) AIR-CONDITIONING APPARATUS

(71) Applicant: Mitsubishi Electric Corporation, Tokyo (JP)

(72) Inventor: Yuya Morishita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 211 days.

(21) Appl. No.: 15/116,985

(22) PCT Filed: Apr. 4, 2014

(86) PCT No.: PCT/JP2014/060024
§ 371 (c)(1),
(2) Date: Aug. 5, 2016

(87) PCT Pub. No.: WO2015/151289
PCT Pub. Date: Oct. 8, 2015

(65) Prior Publication Data

US 2017/0108249 A1 Apr. 20, 2017

(51) Int. Cl.
*F24F 11/83* (2018.01)
*F25B 9/00* (2006.01)
(Continued)

(52) U.S. Cl.
CPC ..... *F24F 11/83* (2018.01); *F25B 9/008* (2013.01); *F25B 13/00* (2013.01); *F25B 41/067* (2013.01);
(Continued)

(58) Field of Classification Search
CPC ..... F25B 13/00; F25B 2313/006; F25B 2313/0253; F25B 2313/02741;
(Continued)

(56) References Cited

U.S. PATENT DOCUMENTS 118,533 A * 8/1871 Hockensmith ..... A44B 9/14 24/710.2
276,280 A * 4/1883 Purdie ..... B29C 37/0017 425/274
(Continued)

FOREIGN PATENT DOCUMENTS

JP S62-108971 A 5/1987
JP 05-322388 A 12/1993
(Continued)

OTHER PUBLICATIONS

Japanese Office Action dated Dec. 13, 2016 in the corresponding JP application No. 2016-511300. (English translation attached).
(Continued)

*Primary Examiner* — Henry Crenshaw
(74) *Attorney, Agent, or Firm* — Posz Law Group, PLC

(57) ABSTRACT

An air-conditioning apparatus includes a heat medium circuit in which a compressor, a flow switching unit, a flow regulating unit, a gas header, a heat source-side heat exchanger, a distributor, an expansion unit, and a use-side heat exchanger are connected by a pipe, and during a defrosting operation to defrost the heat source-side heat exchanger, heat medium circulates, in order, the compressor, the flow switching unit, the gas header, the heat source-side heat exchanger, the distributor, the expansion unit, and the use-side heat exchanger. The heat source-side heat exchanger includes a first heat exchange unit, and a second heat exchange unit provided lower than the first heat exchange unit. The flow regulating unit is configured to, during the defrosting operation, regulate a flow rate of heat medium flowing through the first heat exchange unit and a flow rate of heat medium flowing through the second heat exchange unit.

7 Claims, 7 Drawing Sheets

(51) Int. Cl.
*F25B 13/00* (2006.01)
*F25B 41/06* (2006.01)
*F25B 47/02* (2006.01)

(52) U.S. Cl.
CPC ..... *F25B 47/025* (2013.01); *F25B 2313/006* (2013.01); *F25B 2313/023* (2013.01); *F25B 2313/0253* (2013.01); *F25B 2313/02741* (2013.01); *F25B 2313/0315* (2013.01); *F25B 2600/2515* (2013.01)

(58) Field of Classification Search
CPC ..... F25B 2313/0315; F25B 2600/2515; F25B 41/067; F25B 47/025
USPC ..... 62/156
See application file for complete search history.

(56) References Cited

U.S. PATENT DOCUMENTS

2010/0170270 A1* 7/2010 Jang ..... F25B 13/00 62/81
2011/0232308 A1* 9/2011 Morimoto ..... F25B 13/00 62/132
2012/0118533 A1* 5/2012 Jang ..... F25B 49/02 165/96
2014/0318168 A1* 10/2014 Morimoto ..... F24F 1/36 62/277
2015/0276280 A1* 10/2015 Furui ..... F25B 13/00 62/160
2015/0362222 A1* 12/2015 Matsuda ..... F25B 39/028 62/324.1

FOREIGN PATENT DOCUMENTS

JP 07-280378 A 10/1995
JP H08-061813 A 3/1996
JP 09-318206 A 12/1997
JP 2001-059664 A 3/2001
JP 2002-089980 A 3/2002
JP 2004-347135 A 12/2004
JP 2009-281607 A 12/2009
JP 2012-032120 A 2/2010
JP 2010-164257 A 7/2010
JP 2012-063033 A 3/2012
JP 2012-107857 A 6/2012
JP 2013-061091 A 4/2013

OTHER PUBLICATIONS

International Search Report of the International Searching Authority dated Jul. 1, 2014 for the corresponding international application No. PCT/JP2014/060024 (and English translation).

* cited by examiner

AIR-CONDITIONING APPARATUS

CROSS REFERENCE TO RELATED APPLICATION

This application is a U.S. national stage application of PCT/JP2014/060024 filed on Apr. 4, 2014, the contents of which are incorporated herein by reference.

TECHNICAL FIELD

The present invention relates to an air-conditioning apparatus including a control unit.

BACKGROUND ART

Example applications of air-conditioning apparatuses include multi-air-conditioning apparatuses designed for buildings. In these air-conditioning apparatuses such as multi-air-conditioning apparatuses designed for buildings, typically, a heat source unit is provided with an air-sending device to send air to a heat exchanger. This air-sending device is, for example, a propeller fan. Air is sent to the heat exchanger by the propeller fan. This propeller fan is often installed in an upper part of the heat source unit. If a propeller fan is installed in an upper part of the heat source unit in this way, the resulting distribution of air velocity is such that the air velocity is high in the upper part of the heat exchanger, with the air velocity progressively decreasing toward the lower part of the heat exchanger. This tends to result in deteriorated air velocity balance for the heat source unit. During heating operation, this unbalance of air velocity leads to a decrease in evaporating capacity in the lower part of the heat exchanger where the air velocity is low, resulting in increased frost formation on the lower part of the heat exchanger. This may give rise to a risk that the frost deposited on the lower part of the heat exchanger is not completely melted during defrosting operation.

In order to address this problem, Patent Literature 1 discloses an air-conditioning apparatus including a subcooling heat exchange unit provided in a lower part of a heat exchanger. Patent Literature 1 aims to reduce the amount of frost deposited on the lower part of the heat exchanger through the provision of the subcooling heat exchange unit.

CITATION LIST

Patent Literature

Patent Literature 1: Japanese Unexamined Patent Application Publication No. 2004-347135 (pages 2 to 4)

SUMMARY OF INVENTION

Technical Problem

In the air-conditioning apparatus disclosed in Patent Literature 1, during defrosting operation, the gas refrigerant discharged from the compressor first enters an upper part of the heat exchanger, and exchanges heat in, for example, the upper part of the heat exchanger, causing the temperature of the refrigerant to decrease. The refrigerant at the reduced temperature then enters the subcooling heat exchange unit located in a lower part of the heat exchanger. This may cause the temperature in the lower part of the heat exchanger to be below a temperature required for defrosting. That is, in the lower part of the heat exchanger, the defrosting capacity decreases, resulting in a higher risk of frost remaining unmelted. As described above, in Patent Literature 1, the defrosting capacity is not uniform throughout the entire heat exchanger.

The present invention is made in view of the above-mentioned problem, and accordingly provides an air-conditioning apparatus that allows defrosting capacity to be made uniform throughout the entire heat exchanger during defrosting operation.

Solution to Problem

An air-conditioning apparatus according to one embodiment of the present invention includes a heat medium circuit in which a compressor, a heat source-side heat exchanger including a first heat exchange unit and a second heat exchange unit connected to the first heat exchange unit, an expansion unit, and a use-side heat exchanger are connected by a pipe, and through which a heat medium flows, a first temperature detecting unit configured to detect an outlet temperature of the first heat exchange unit, a second temperature detecting unit configured to detect an outlet temperature of the second heat exchange unit, a flow regulating unit configured to regulate a flow rate of the heat medium routed through each of the first heat exchange unit and the second heat exchange unit, and a control unit configured to control operation of the flow regulating unit. The control unit includes a first determining unit configured to, during defrosting operation, determine whether a difference between the outlet temperature of the first heat exchange unit detected by the first temperature detecting unit, and the outlet temperature of the second heat exchange unit detected by the second temperature detecting unit is greater than a predetermined differential temperature threshold, a second determining unit configured to, if it is determined by the first determining unit that the difference is greater than the differential temperature threshold, determine whether the outlet temperature of the first heat exchange unit detected by the first temperature detecting unit is higher than the outlet temperature of the second heat exchange unit detected by the second temperature detecting unit, and a flow control unit configured to, if it is determined by the second determining unit that the outlet temperature of the first heat exchange unit is higher than the outlet temperature of the second heat exchange unit, control the flow regulating unit to reduce a flow rate of the heat medium routed through the first heat exchange unit.

Advantageous Effects of Invention

According to one embodiment of the present invention, if it is determined by the second determining unit that the outlet temperature of the first heat exchange unit is higher than the outlet temperature of the second heat exchange unit, the flow control unit controls the flow regulating unit to reduce the flow rate of the heat medium routed through the first heat exchange unit. This allows defrosting capacity to be made uniform throughout the entire heat source-side heat exchanger.

DESCRIPTION OF EMBODIMENTS

Figure 1:
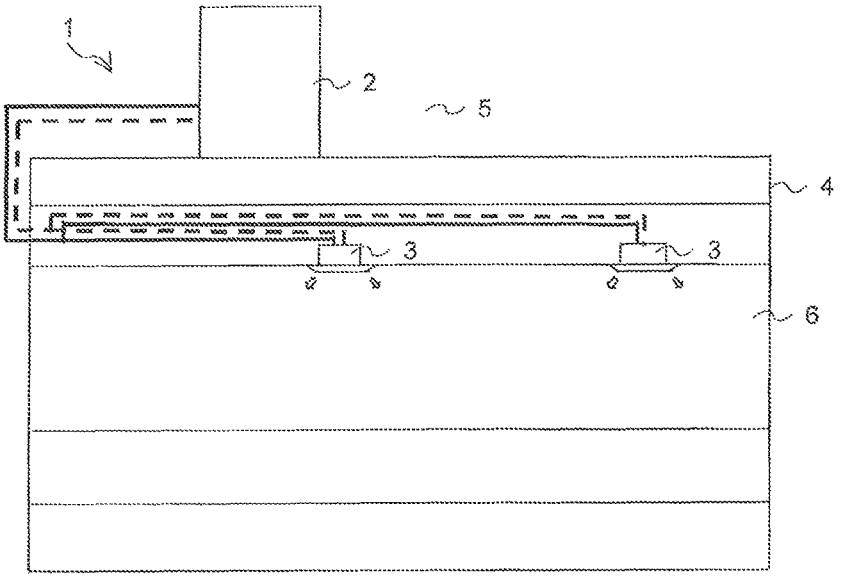
FIG. 1 is a diagram for illustrating an air-conditioning apparatus 1 according to Embodiment 1.

Hereinafter, embodiments of an air-conditioning apparatus according to the present invention will be described with reference to the drawings. The present invention is not limited to the embodiments described below. The relative sizes of various components are not necessarily to scale in the drawings including FIG. 1.

Embodiment 1

FIG. 1 is a diagram for illustrating an air-conditioning apparatus 1 according to Embodiment 1. The air-conditioning apparatus 1 will be described with reference to FIG. 1. In the air-conditioning apparatus 1, a heat source unit (outdoor unit 2) in which heat is exchanged between the outdoor air and a heat medium, and an indoor unit 3 in which heat is exchanged between the indoor air and the heat medium are used and incorporated into a heat medium circuit 10 through which the heat medium circulates, thus performing cooling operation and heating operation.

As illustrated in FIG. 1, the air-conditioning apparatus 1 includes a single outdoor unit 2 serving as a heat source unit and, for example, two indoor units 3. The outdoor unit 2 is installed outside a building 4 such as a multi storied building, for example, at an outdoor space 5 such as the rooftop. Further, the indoor unit 3 is installed on the ceiling of an indoor space 6 in a living room inside the building 4, for example, a server room. The outdoor unit 2 and the indoor unit 3 are connected by pipes, and the heat medium circulates through these units.

The outdoor unit 2 generates cooling energy or heating energy, and supplies the cooling energy or heating energy to the indoor unit 3. The indoor unit 3 supplies cooling air or heating air to the indoor space 6. The indoor unit 3 may be installed underfloor to serve as floor heating that heats the floor surface by means of the heating energy conveyed by the heat medium. Although two indoor units 3 are connected to a single outdoor unit 2 in Embodiment 1, the number of outdoor units 2 and indoor units 3 may be changed as appropriate.

Refrigerant may be used as the heat medium for use in the air-conditioning apparatus 1. For example, the refrigerant used may be a single-component refrigerant such as R-22, R-134a, or R-32, a near-azeotropic refrigerant mixture such as R-410A or R-404A, or a zeotropic refrigerant mixture such as R-407C. Further, the refrigerant used may be a refrigerant containing a double bond in its chemical formula and having a relatively low global warming potential, such as $CF_3CF{=}CH_2$, or a mixture containing the refrigerant. Further, the refrigerant used may be a natural refrigerant, such as $CO_2$ or propane. Alternatively, for example, water, brine, a mixed solution of water and brine, or a mixed solution of water and an additive with high anticorrosive effect can be used.

Figure 2:
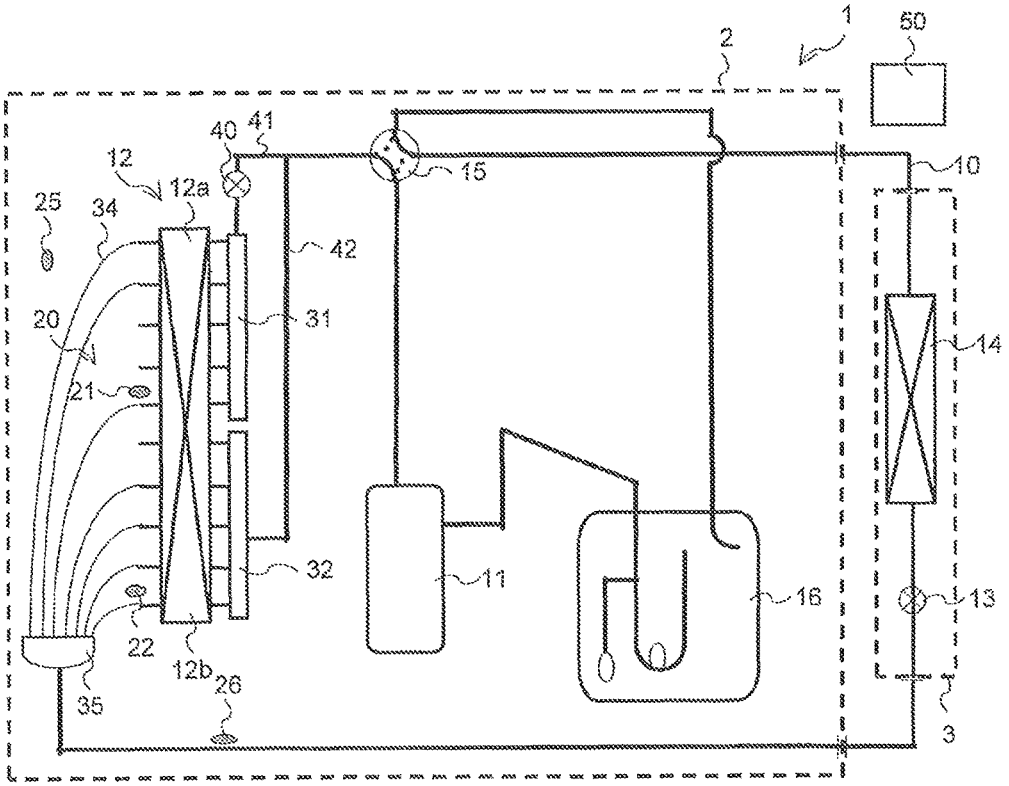
FIG. 2 is a circuit diagram for illustrating the air-conditioning apparatus 1 according to Embodiment 1.

FIG. 2 is a circuit diagram for illustrating the air-conditioning apparatus 1 according to Embodiment 1. As illustrated in FIG. 2, the air-conditioning apparatus 1 includes a heat medium circuit 10, a temperature detecting unit 20, and a control unit 50. In the heat medium circuit 10, a compressor 11, a heat source-side heat exchanger 12, an expansion unit 13, and a use-side heat exchanger 14 are connected by pipes, allowing the heat medium to flow through the heat medium circuit 10. Further, the heat medium circuit 10 includes a flow switching unit 15, and an accumulator 16. Of these components, the compressor 11, the flow switching unit 15, the heat source-side heat exchanger 12, and the accumulator 16 are installed in the outdoor unit 2, and the expansion unit 13 and the use-side heat exchanger 14 are installed in the indoor unit 3. Although FIG. 2 depicts an arrangement in which a single outdoor unit 2 and a single indoor unit 3 are installed, and the outdoor unit 2 and the indoor unit 3 are connected by pipes, a plurality of outdoor units 2 and a plurality of indoor units 3 may be provided.

First, the outdoor unit 2 will be described. The compressor 11 compresses a heat medium. The compressor 11 may be an inverter compressor including a device such as an inverter device. In this case, changing the driving frequency (rotation speed) as appropriate allows the capacity (the amount of heat medium delivered per unit time) of the compressor 11 to be varied in a precise manner. The flow switching unit 15 switches the direction in which the heat medium flows through the heat medium circuit 10. The flow switching unit 15 switches the direction in which the heat medium flows during heating operation, cooling operation, and defrosting operation. The flow switching unit 15 may be implemented by, for example, a four-way valve.

The heat source-side heat exchanger 12 exchanges heat between the outdoor air sent by the air-sending device (not illustrated) and the heat medium. The heat source-side heat exchanger 12 is a fin tube heat exchanger including heat transfer tubes and heat transfer fins. In heating operation, the heat source-side heat exchanger 12 serves as an evaporator to exchange heat between a low-pressure heat medium that comes from the indoor unit 3 via pipes, and the outdoor air, causing the heat medium to be evaporated into a gas. In cooling operation and defrosting operation, the heat source-side heat exchanger 12 serves as a condenser to exchange heat between a high-pressure heat medium compressed and discharged by the compressor 11 and the outdoor air, causing the heat medium to be condensed into a liquid.

The heat source-side heat exchanger 12 also includes a first heat exchange unit 12*a*, and a second heat exchange unit 12*b* connected to the first heat exchange unit 12*a*. A first gas header 31 is provided on the inflow side of a gaseous heat medium with respect to the first heat exchange unit 12*a*. The first gas header 31 and the first heat exchange unit 12*a* are connected by a plurality of branch pipes. A second gas header 32 is provided on the inflow side of a gaseous heat medium with respect to the second heat exchange unit 12*b*. The second gas header 32 and the second heat exchange unit 12*b* are also connected by a plurality of branch pipes. The first heat exchange unit 12*a* and the second heat exchange unit 12*b* are thus connected in parallel in the heat source-side heat exchanger 12.

For example, depending on where the air-sending device is installed, air may impinge on the first heat exchange unit 12*a* at a high velocity. In that case, the number of branch pipes connecting the first gas header 31 and the first heat exchange unit 12*a* is preferably greater than the number of branch pipes connecting the second gas header 32 and the second heat exchange unit 12*b*. This allows a greater amount of heat medium to be routed into the first heat exchange unit 12*a* subjected to high air velocity.

The flow switching unit 15 and the heat source-side heat exchanger 12 are connected by a first connecting pipe 41 and a second connecting pipe 42. Of these connecting pipes, the first connecting pipe 41 connects the flow switching unit 15 and the first gas header 31, and the second connecting pipe 42 connects the flow switching unit 15 and the second gas header 32. This causes the heat medium from the flow switching unit 15 to branch into two flows, one flowing into the first gas header 31 through the first connecting pipe 41, the other flowing into the second gas header 32 through the second connecting pipe 42.

The side of the first heat exchange unit 12*a* and the second heat exchange unit 12*b* where a liquid heat medium exits is connected with a plurality of capillary tubes 34. The capillary tubes 34 are gathered in a distributor 35, causing the flows of heat medium inside the individual capillary tubes 34 to merge.

The accumulator 16 is located on the suction side (low-pressure side) of the compressor 11 in the heat medium circuit 10. The accumulator 16 accumulates a surplus heat medium in liquid form produced as a result of, for example, the difference in the required amount of heat medium between heating operation and cooling operation, or adaptation to transient operation changes.

Next, the indoor unit 3 will be described. The expansion unit 13 allows the heat medium passing through the expansion unit 13 to expand by reducing its pressure. The expansion unit 13 is installed upstream of the use-side heat exchanger 14 with respect to the direction in which the heat medium flows during cooling operation. The expansion unit 13, which can be implemented by, for example, a pressure reducing valve or expansion valve, may be an electronic expansion valve or other devices. This allows for fine control of the opening degree of the expansion unit 13. The use-side heat exchanger 14 exchanges heat between the air of the indoor space, which is the air-conditioned space, and the heat medium. When the heat medium is conveying heating energy, the indoor air is heated to perform heating operation, and when the heat medium is conveying cooling energy, the indoor air is cooled to perform cooling operation.

The temperature detecting unit 20 detects the outlet temperature of the heat source-side heat exchanger 12. The temperature detecting unit 20 includes a first temperature detecting unit 21, and a second temperature detecting unit 22. The first temperature detecting unit 21 is attached to one capillary tube 34 extending from the first heat exchange unit 12*a* to detect the outlet temperature of the first heat exchange unit 12*a*. The second temperature detecting unit 22 is attached to one capillary tube 34 extending from the second heat exchange unit 12*b* to detect the outlet temperature of the second heat exchange unit 12*b*.

Although only one first temperature detecting unit 21 and only one second temperature detecting unit 22 are each attached to one capillary tube 34 in Embodiment 1, the first temperature detecting unit 21 and the second temperature detecting unit 22 may each be attached to a plurality of capillary tubes 34. If only one first temperature detecting unit 21 and only one second temperature detecting unit 22 are to be attached as in Embodiment 1, preferably, the capillary tube 34 subjected to the greatest drop in temperature of the tube during defrosting operation is selected as the capillary tube 34 to which the corresponding temperature detecting unit is attached.

For example, the length of each individual capillary tube 34 that couples the distributor 35 and the heat source-side heat exchanger 12 may be varied depending on its location. The shorter the capillary tube 34, the greater the flow rate of the heat medium passing through the capillary tube 34, leading to increased frost deposition during heating operation. When each of the first temperature detecting unit 21 and the second temperature detecting unit 22 is thus attached to the capillary tube 34 that is shorter than the other capillary tubes 34, this makes it possible to detect the temperature of the capillary tube 34 that has dropped in temperature owing to the increased frost deposition.

The air-conditioning apparatus 1 further includes an outside-air temperature detecting unit 25, and a heat medium temperature detecting unit 26. The outside-air temperature detecting unit 25, which detects the temperature of the outdoor air, is located around the heat source-side heat exchanger 12. Thus, in particular, the temperature of the outdoor air near the heat source-side heat exchanger 12 is detected. The heat medium temperature detecting unit 26 detects the temperature of the heat medium, in particular, the temperature of the heat medium that is in liquid form. The heat medium temperature detecting unit 26 is located at a position where the heat medium exits the outdoor unit 2 in cooling operation (a position where the heat medium enters the outdoor unit 2 in heating operation).

The heat medium circuit 10 further includes a flow regulating unit 40. The flow regulating unit 40 regulates the flow rate of the heat medium routed through each of the first heat exchange unit 12*a* and the second heat exchange unit 12*b*. The flow regulating unit 40 is installed in the first connecting pipe 41 that connects the flow switching unit 15 and the first gas header 31. The opening degree of the flow regulating unit 40 is adjusted to regulate the flow rate of the heat medium that is routed into the first heat exchange unit 12*a* through the first connecting pipe 41. The flow regulating unit 40, which may be provided in at least one of the first connecting pipe 41 and the second connecting pipe 42, may be provided in both of the first connecting pipe 41 and the second connecting pipe 42.

When the flow regulating unit 40 is fully opened, the flow rate of the heat medium routed through the first connecting pipe 41 and the flow rate of the heat medium routed through the second connecting pipe 42 become substantially equal, and thus the flow rate of the heat medium routed through the first heat exchange unit 12*a* and the flow rate of the heat medium routed through the second heat exchange unit 12*b* become substantially equal. Then, as the flow regulating unit 40 is progressively closed, the flow rate of the heat medium routed through the first connecting pipe 41 decreases, causing the flow rate of the heat medium routed through the first heat exchange unit 12*a* to decrease. Once the flow regulating unit 40 is fully closed, there is no longer any flow of heat medium through the first connecting pipe 41 and the first heat exchange unit 12*a*, and the heat medium flows through only the second connecting pipe 42 and the second heat exchange unit 12*b*.

Figure 3:
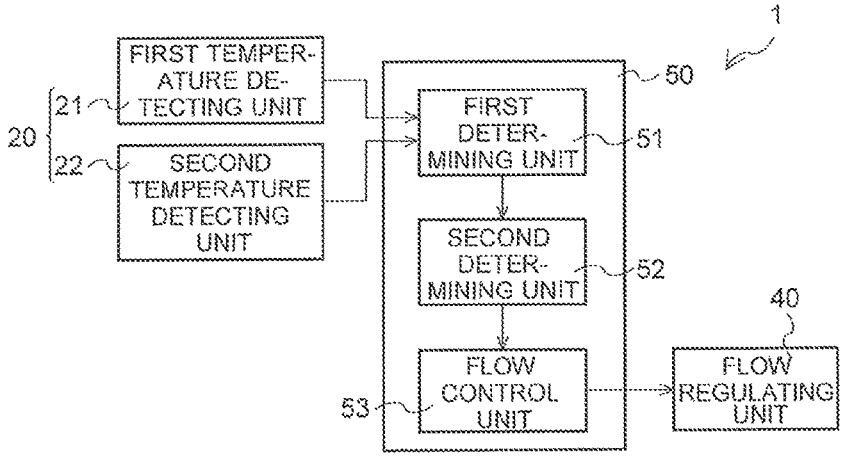
FIG. 3 is a block diagram for illustrating a control unit 50 according to Embodiment 1.

The control unit 50 controls the behavior of the heat medium in such a way that during defrosting operation, the frost deposited on the first heat exchange unit 12*a* and the second heat exchange unit 12*b* is removed based on the outlet temperature of the heat source-side heat exchanger 12 detected by the temperature detecting unit 20. FIG. 3 is a block diagram for illustrating the control unit 50 according to Embodiment 1. As illustrated in FIG. 3, the control unit 50 includes a first determining unit 51, a second determining unit 52, and a flow control unit 53.

The first determining unit 51 determines, during defrosting operation, whether the difference between the outlet temperature of the first heat exchange unit 12*a* detected by the first temperature detecting unit 21, and the outlet temperature of the second heat exchange unit 12*b* detected by the second temperature detecting unit 22 is greater than a predetermined differential temperature threshold. The differential temperature threshold is, for example, one degree C.

The second determining unit 52 determines, if it is determined by the first determining unit 51 that the difference is greater than the differential temperature threshold, whether the outlet temperature of the first heat exchange unit 12*a* detected by the first temperature detecting unit 21 is higher than the outlet temperature of the second heat exchange unit 12*b* detected by the second temperature detecting unit 22.

If a plurality of first temperature detecting units 21 and a plurality of second temperature detecting units 22 are provided, the mean value of a plurality of outlet temperatures of the first heat exchange unit 12*a* detected by the first temperature detecting units 21 may be used as the outlet temperature of the first heat exchange unit 12*a*. Further, the mean value of a plurality of outlet temperatures of the second heat exchange unit 12*b* detected by the second temperature detecting units 22 may be used as the outlet temperature of the second heat exchange unit 12*b*.

Further, if it is determined by the second determining unit 52 that the outlet temperature of the first heat exchange unit 12*a* is higher than the outlet temperature of the second heat exchange unit 12*b*, the flow control unit 53 controls the flow regulating unit 40 to reduce the flow rate of the heat medium routed through the first heat exchange unit 12*a*.

Next, heating operation, cooling operation, and defrosting operation of the air-conditioning apparatus 1 according to Embodiment 1 will be described.

First, heating operation will be described. The compressor 11 sucks and compresses a heat medium, and discharges the heat medium in a high-temperature, high-pressure gaseous state. The discharged heat medium passes through the flow switching unit 15, and enters the use-side heat exchanger 14. The use-side heat exchanger 14 causes the heat medium to be condensed through heat exchange with the indoor air. The condensed heat medium enters the expansion unit 13. The expansion unit 13 reduces the pressure of the condensed heat medium. The heat medium that has been reduced in pressure then enters the distributor 35, and enters the heat source-side heat exchanger 12 through the capillary tubes 34. The heat source-side heat exchanger 12 causes the heat medium to be evaporated through heat exchange with the outdoor air.

The heat medium routed into the first heat exchange unit 12*a* of the heat source-side heat exchanger 12 enters the first gas header 31, and passes through the first connecting pipe 41 to reach the flow switching unit 15. In heating operation, the flow regulating unit 40 is fully open. The heat medium routed into the second heat exchange unit 12*b* of the heat source-side heat exchanger 12 enters the second gas header 32, and passes through the second connecting pipe 42 to reach the flow switching unit 15. After the two flows of heat medium merge at a position upstream of the flow switching unit 15, the resulting heat medium passes through the flow switching unit 15, and then enters the accumulator 16 and is sucked into the compressor 11.

Next, cooling operation will be described. The compressor 11 sucks and compresses a heat medium, and discharges the heat medium in a high-temperature, high-pressure gaseous state. The discharged heat medium passes through the flow switching unit 15, and then branches into the first connecting pipe 41 and the second connecting pipe 42. The heat medium routed into the first connecting pipe 41 enters the first gas header 31, and then enters the first heat exchange unit 12*a* of the heat source-side heat exchanger 12. In cooling operation, the flow regulating unit 40 is fully open. Further, the heat medium routed into the second connecting pipe 42 enters the second gas header 32, and then enters the second heat exchange unit 12*b* of the heat source-side heat exchanger 12. The heat source-side heat exchanger 12 causes the heat medium to be condensed through heat exchange with the outdoor air.

The heat medium entering the first heat exchange unit 12*a* and the heat medium entering the second heat exchange unit 12*b* pass through the capillary tubes 34 and merge at the distributor 35. Then, the condensed heat medium enters the expansion unit 13. The expansion unit 13 reduces the pressure of the condensed heat medium. The heat medium that has been reduced in pressure then enters the use-side heat exchanger 14. The use-side heat exchanger 14 causes the heat medium to be evaporated through heat exchange with the indoor air. Then, the evaporated heat medium passes through the flow switching unit 15, and then enters the accumulator 16 and is sucked into the compressor 11.

Next, defrosting operation will be described. The compressor 11 sucks and compresses a heat medium, and discharges the heat medium in a high-temperature, high-pressure gaseous state. The discharged heat medium passes through the flow switching unit 15, and then branches into the first connecting pipe 41 and the second connecting pipe 42. The heat medium routed into the first connecting pipe 41 enters the first gas header 31, and then enters the first heat exchange unit 12*a* of the heat source-side heat exchanger 12. In defrosting operation, the opening degree of the flow regulating unit 40 is changed as appropriate. The heat medium routed into the second connecting pipe 42 enters the second gas header 32, and then enters the second heat exchange unit 12*b* of the heat source-side heat exchanger 12. The heat source-side heat exchanger 12 causes the heat medium to be condensed through heat exchange with the outdoor air.

The heat medium entering the first heat exchange unit 12*a* and the heat medium entering the second heat exchange unit 12*b* pass through the capillary tubes 34 and merge at the distributor 35. Then, the condensed heat medium enters the expansion unit 13. The expansion unit 13 reduces the pressure of the condensed heat medium. The heat medium that has been reduced in pressure then enters the use-side heat exchanger 14. The use-side heat exchanger 14 causes the heat medium to be evaporated through heat exchange with the indoor air. Then, the evaporated heat medium passes through the flow switching unit 15, and then enters the accumulator 16 and is sucked into the compressor 11.

Figure 4:
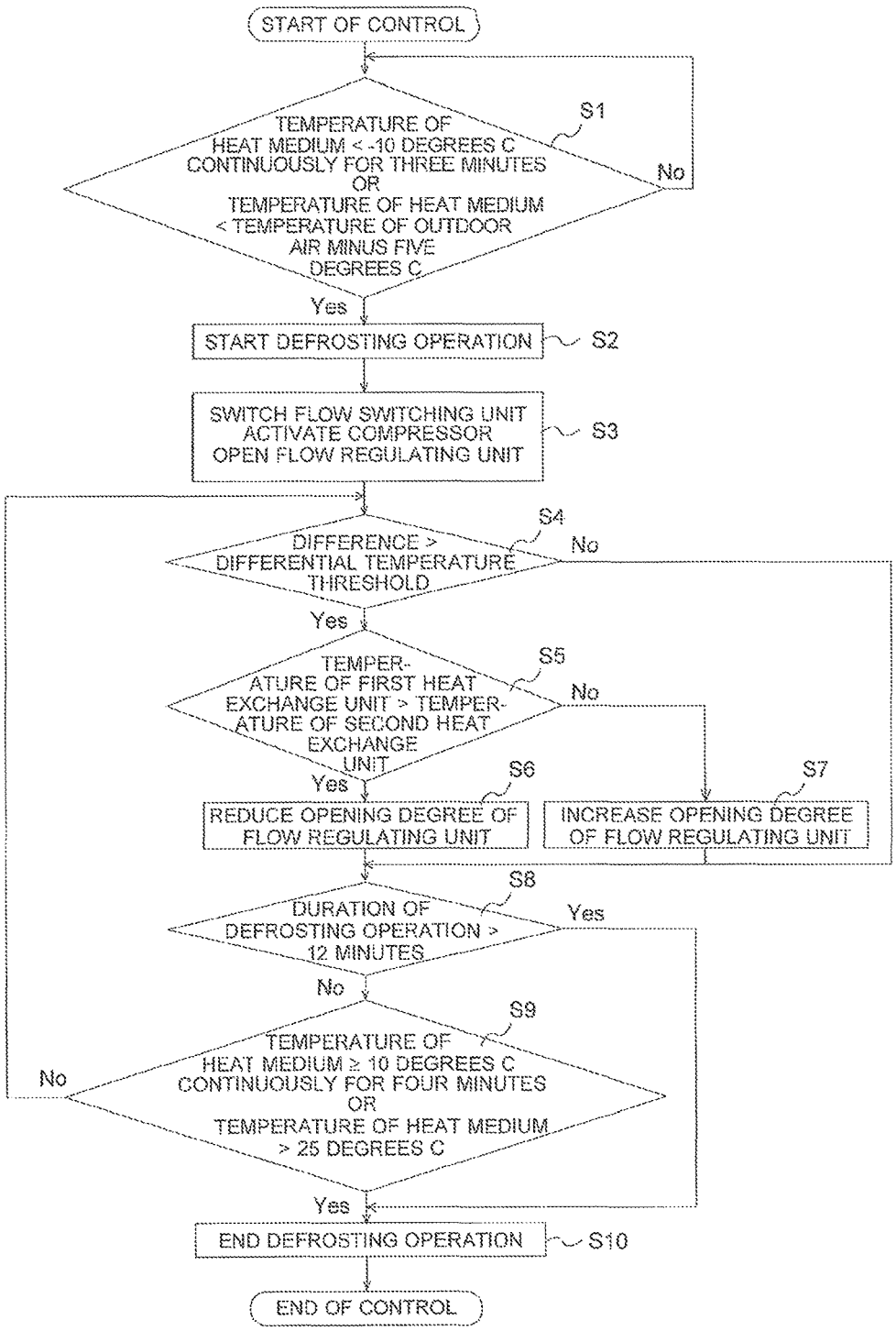
FIG. 4 is a flowchart for illustrating operation of the air-conditioning apparatus 1 according to Embodiment 1.

Next, operation of the air-conditioning apparatus 1 according to Embodiment 1 will be described. FIG. 4 is a flowchart for illustrating operation of the air-conditioning apparatus 1 according to Embodiment 1. As illustrated in FIG. 4, while heating operation is performed, the control unit 50 determines whether to perform defrosting operation (step S1).

For example, the defrosting operation is started if a predetermined temperature is detected by the heat medium temperature detecting unit 26 for a predetermined duration of time. In this case, the predetermined temperature is a fixed value of, for example, −10 degrees C., and the predetermined duration of time is, for example, three minutes. The defrosting operation may be started if the temperature of the heat medium detected by the heat medium temperature detecting unit 26 is lower than the temperature of the outdoor air detected by the outside-air temperature detecting unit 25 by a predetermined temperature. The predetermined temperature is, for example, five degrees C.

If the above-mentioned condition is not satisfied (step S1; No), step S1 is repeated. If the above-mentioned condition is satisfied (step S1; Yes), the defrosting operation is started (step S2). Then, the flow switching unit 15 is switched, operation of the compressor 11 is started, and the flow regulating unit 40 is opened to a predetermined opening degree (step S3). The compressor 11 operates at a predetermined frequency. In this regard, the frequency of the compressor 11 may be determined based on the temperature of the heat medium detected by the heat medium temperature detecting unit 26, the outlet temperature of the first heat exchange unit 12*a* detected by the first temperature detecting unit 21, or the outlet temperature of the second heat exchange unit 12*b* detected by the second temperature detecting unit 22.

Next, it is determined by the first determining unit 51 whether the difference between the outlet temperature of the first heat exchange unit 12*a* detected by the first temperature detecting unit 21, and the outlet temperature of the second heat exchange unit 12*b* detected by the second temperature detecting unit 22 is greater than a predetermined differential temperature threshold (step S4). If it is determined that the difference is less than the differential temperature threshold (step S4; No), the opening degree of the flow regulating unit 40 is not adjusted, and the processing proceeds to step S8.

If the outlet temperature of the first heat exchange unit 12*a* and the outlet temperature of the second heat exchange unit 12*b* are close to each other, the growth of frost on the first heat exchange unit 12*a* and the growth of frost on the second heat exchange unit 12*b* are regarded as substantially equal, and thus the flow regulating unit 40 is maintained at a predetermined opening degree. If it is determined that the difference is greater than the differential temperature threshold (step S4; Yes), the processing proceeds to the next step S5.

In step S5, it is determined by the second determining unit 52 whether the outlet temperature of the first heat exchange unit 12*a* detected by the first temperature detecting unit 21 is higher than the outlet temperature of the second heat exchange unit 12*b* detected by the second temperature detecting unit 22. If the outlet temperature of the first heat exchange unit 12*a* is higher than the outlet temperature of the second heat exchange unit 12*b* (step S5; Yes), the opening degree of the flow regulating unit 40 is reduced by the flow control unit 53 (step S6). As a result, the flow rate of the heat medium routed through the first heat exchange unit 12*a* is reduced. The processing then proceeds to step S8.

By contrast, if the outlet temperature of the first heat exchange unit 12*a* is lower than the outlet temperature of the second heat exchange unit 12*b* (step S5; No), the opening degree of the flow regulating unit 40 is increased by the flow control unit 53 (step S7). As a result, the flow rate of the heat medium routed through the first heat exchange unit 12*a* is increased. The processing then proceeds to step S8.

In step S8, it is determined by the control unit 50 whether a predetermined duration of defrosting operation has elapsed. In this case, the predetermined duration is, for example, 12 minutes. If 12 minutes have elapsed since the start of the defrosting operation (step S8; Yes), the processing proceeds to step S10. If 12 minutes have not elapsed since the start of the defrosting operation (step S8; No), the processing proceeds to the next step S9.

In step S9, it is determined whether the control unit 50 forces the defrosting operation to end even if 12 minutes have not elapsed since the start of the defrosting operation. For example, the defrosting operation is ended if a predetermined temperature is detected by the heat medium temperature detecting unit 26 for a predetermined duration of time. In this case, the predetermined temperature is, for example, 10 degrees C., and the predetermined duration of time is, for example, four minutes. The defrosting operation may be immediately ended if the temperature of the heat medium detected by the heat medium temperature detecting unit 26 exceeds a predetermined temperature. The predetermined temperature is, for example, 25 degrees C.

If the above-mentioned condition is not satisfied (step S9; No), the processing returns to step S4. If the above-mentioned condition is satisfied (step S9; Yes), the defrosting operation is ended (step S10).

As described above, in the air-conditioning apparatus 1 according to Embodiment 1, if it is determined by the second determining unit 52 that the outlet temperature of the first heat exchange unit 12*a* is higher than the outlet temperature of the second heat exchange unit 12*b*, the flow control unit 53 controls the flow regulating unit 40 to reduce the flow rate of the heat medium routed through the first heat exchange unit 12*a*. This allows defrosting capacity to be made uniform throughout the entire heat source-side heat exchanger 12.

Further, in Embodiment 1, if the difference is greater than the differential temperature threshold, and the outlet temperature of the first heat exchange unit 12*a* is higher than the outlet temperature of the second heat exchange unit 12*b*, this leads to a significant growth of the frost deposited on the second heat exchange unit 12*b*. This increases the amount of heat that needs to be rejected to melt this frost, and thus the outlet temperature of the second heat exchange unit 12*b* is determined to be low. Accordingly, the opening degree of the flow regulating unit 40 is reduced. Thus, the flow rate of the heat medium routed through the first heat exchange unit 12*a* is reduced, and the flow rate of the heat medium routed through the second heat exchange unit 12*b* is increased relatively. This allows for more heat rejection in the second heat exchange unit 12*b*, thus facilitating melting of frost. This prevents frost from remaining unmelted.

Further, in Embodiment 1, if the difference is greater than the differential temperature threshold, and the outlet temperature of the first heat exchange unit 12*a* is lower than the outlet temperature of the second heat exchange unit 12*b*, it is determined that an excessive heat medium is flowing into the second heat exchange unit 12*b*. Accordingly, the opening degree of the flow regulating unit 40 is increased to increase the flow rate of the heat medium routed through the first heat exchange unit 12*a*, and the flow rate of the heat medium routed through the second heat exchange unit 12*b* is decreased relatively. This prevents an excessive heat medium from being routed through the second heat exchange unit 12*b*, thus enabling uniform defrosting of the first heat exchange unit 12*a* and the second heat exchange unit 12*b*.

Embodiment 2

Figure 5:
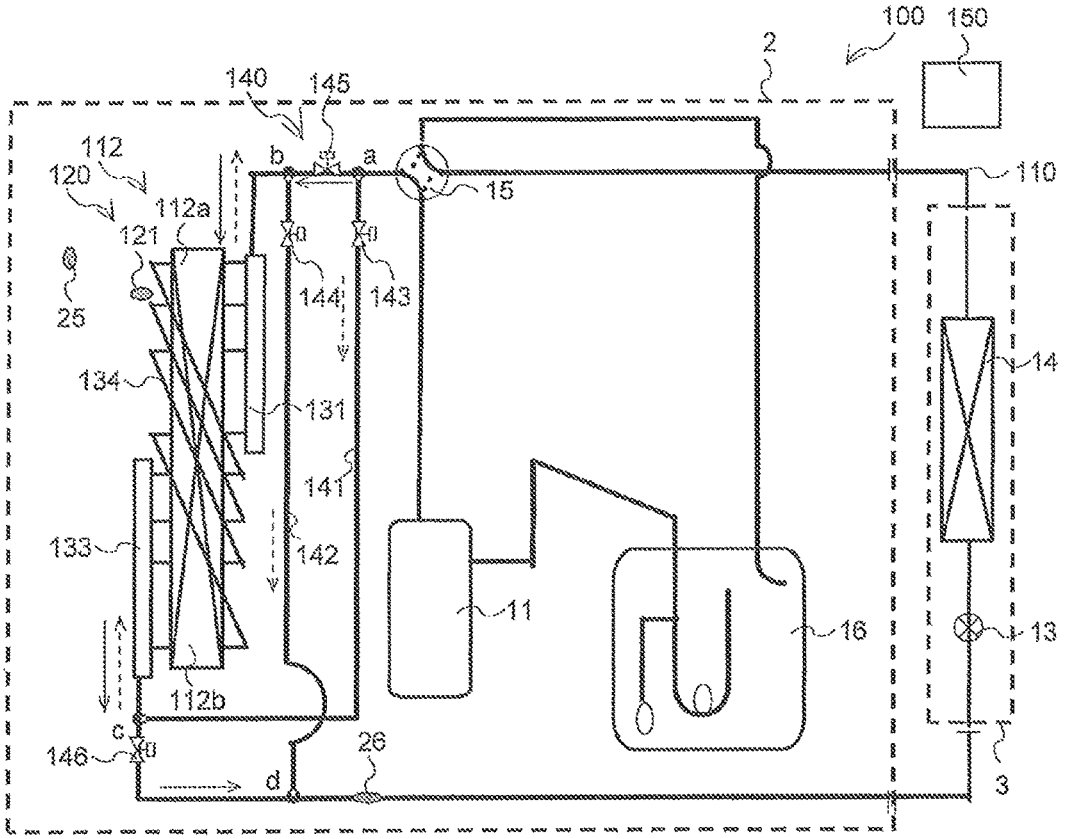
FIG. 5 is a circuit diagram for illustrating an air-conditioning apparatus 100 according to Embodiment 2.

Next, operation of an air-conditioning apparatus 100 according to Embodiment 2 will be described. FIG. 5 is a circuit diagram for illustrating the air-conditioning apparatus 100 according to Embodiment 2. As illustrated in FIG. 5, Embodiment 2 differs from Embodiment 1 in the configuration of a heat source-side heat exchanger 112. Embodiment 2 also differs from Embodiment 1 in that a heat medium circuit 110 includes an order switching unit 140, and that the flow regulating unit 40 is not provided. In Embodiment 2, portions that are the same as those in Embodiment 1 are denoted by identical reference signs to avoid repetitive description and the description mainly focuses on differences from Embodiment 1.

The heat source-side heat exchanger 112 includes a coupling pipe 134. The coupling pipe 134 connects the outlet side of a first heat exchange unit 112*a* with the inlet side of a second heat exchange unit 112*b*. Thus, the first heat exchange unit 112*a* and the second heat exchange unit 112*b* are connected in series in the heat source-side heat exchanger 112. In Embodiment 2, a plurality of coupling pipes 134 are provided. The side of the first heat exchange unit 112*a* where a liquid heat medium exits and the side of the second heat exchange unit 112*b* where a liquid heat medium enters are connected by the plurality of coupling pipes 134.

A first gas header 131 is provided on the inflow side of a gaseous heat medium with respect to the first heat exchange unit 112*a*. The first gas header 131 and the first heat exchange unit 112*a* are connected by a plurality of branch pipes. Further, a second liquid header 133 is provided on the outflow side of a liquid heat medium with respect to the second heat exchange unit 112*b*. The second liquid header 133 and the second heat exchange unit 112*b* are also connected by a plurality of branch pipes.

The order switching unit 140 includes a first bypass pipe 141, a second bypass pipe 142, a first order-switching valve 143, a second order-switching valve 144, a third order-switching valve 145, and a fourth order-switching valve 146. The first bypass pipe 141 connects one end, "a", of the flow switching unit 15 and one end, "c", of the heat source-side heat exchanger 112. The second bypass pipe 142 connects the other end, "b", of the heat source-side heat exchanger 112 and one end, "d" of the expansion unit 13. The first order-switching valve 143 is provided in the first bypass pipe 141, that is, between the ends "a" and "c", and the second order-switching valve 144 is provided in the second bypass pipe 142, that is, between the ends "b" and "d". Further, the third order-switching valve 145 is provided between the ends "a" and "b", and the fourth order-switching valve 146 is provided between the ends "c" and "d".

Of these valves, the first order-switching valve 143 and the second order-switching valve 144 are operatively associated with each other, and the third order-switching valve 145 and the fourth order-switching valve 146 are operatively associated with each other. During cooling operation and heating operation, the first order-switching valve 143 and the second order-switching valve 144 are closed, and the third order-switching valve 145 and the fourth order-switching valve 146 are opened. As a result, the heat medium enters or exits the heat source-side heat exchanger 112 without passing through the first bypass pipe 141 and the second bypass pipe 142.

By contrast, during defrosting operation, there are two cases depending on the condition, one in which the first order-switching valve 143 and the second order-switching valve 144 are closed and the third order-switching valve 145 and the fourth order-switching valve 146 are opened as in cooling operation and heating operation, the other in which the first order-switching valve 143 and the second order-switching valve 144 are opened and the third order-switching valve 145 and the fourth order-switching valve 146 are closed.

In a case in which the first order-switching valve 143 and the second order-switching valve 144 are closed, and the third order-switching valve 145 and the fourth order-switching valve 146 are opened, the heat medium enters or exits the heat source-side heat exchanger 112 without passing through the first bypass pipe 141 and the second bypass pipe 142. In a case where the first order-switching valve 143 and the second order-switching valve 144 are opened, and the third order-switching valve 145 and the fourth order-switching valve 146 are closed, the heat medium enters the heat source-side heat exchanger 112 through the first bypass pipe 141, and then enters the second bypass pipe 142.

In Embodiment 2, a temperature detecting unit 120 can be implemented as, for example, a coupling-pipe temperature detecting unit 121. The coupling-pipe temperature detecting unit 121 is attached to one coupling pipe 134 that connects the first heat exchange unit 112*a* and the second heat exchange unit 112*b*. The coupling-pipe temperature detecting unit 121 detects the outlet temperature of, in particular, the first heat exchange unit 112*a* of the heat source-side heat exchanger 112.

Although only one coupling-pipe temperature detecting unit 121 is attached to one coupling pipe 134 in Embodiment 2, the coupling-pipe temperature detecting unit 121 may be attached to a plurality of coupling pipes 134. If only one coupling-pipe temperature detecting unit 121 is to be attached as in Embodiment 2, preferably, the coupling pipe 134 subjected to the greatest drop in temperature of the pipe during defrosting operation is selected as the coupling pipe 134 to which the coupling-pipe temperature detecting unit 121 is attached.

For example, the length of each individual coupling pipe 134 that couples the first heat exchange unit 112*a* and the second heat exchange unit 112*b* may be varied depending on its location. The shorter the coupling pipe 134, the greater the flow rate of heat medium through the coupling pipe 134, leading to increased frost deposition during heating operation. Attaching the coupling-pipe temperature detecting unit 121 to the coupling pipe 134 that is shorter than the other coupling pipes 134 in this way makes it possible to detect the temperature of the coupling pipe 134 that has dropped in temperature owing to the increased frost deposition. As for the length of each individual coupling pipe 134, only the coupling pipe 134 to which the coupling-pipe temperature detecting unit 121 is attached may be reduced in length, or the coupling pipes 134 other than the coupling pipe 134 to which the coupling-pipe temperature detecting unit 121 is attached may be increased in length.

Figure 6:
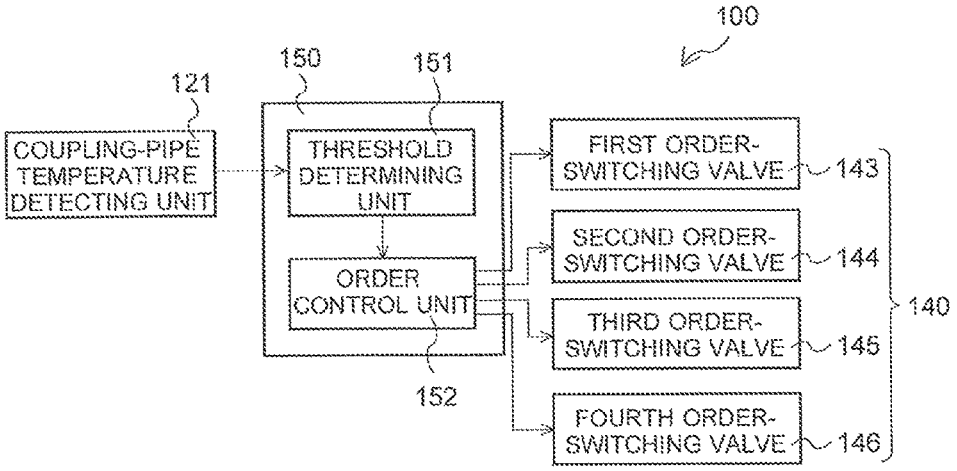
FIG. 6 is a block diagram for illustrating a control unit 150 according to Embodiment 2.

A control unit 150 controls the behavior of the heat medium in such a way that during defrosting operation, the frost deposited on the first heat exchange unit 112*a* and the second heat exchange unit 112*b* is removed based on the outlet temperature of the heat source-side heat exchanger 112 detected by the temperature detecting unit 120. FIG. 6 is a block diagram for illustrating the control unit 150 according to Embodiment 2. As illustrated in FIG. 6, the control unit 150 includes a threshold determining unit 151, and an order control unit 152.

The threshold determining unit 151 determines, during defrosting operation, whether the outlet temperature of the heat source-side heat exchanger 112 detected by the temperature detecting unit 120, for example, the coupling-pipe temperature detecting unit 121, is higher than a predetermined threshold temperature. The threshold temperature is, for example, 25 degrees C. As described above, the coupling-pipe temperature detecting unit 121 may be attached to a plurality of coupling pipes 134. In this case, the mean value of a plurality of outlet temperatures of the first heat exchange unit 112*a* detected by a plurality of coupling-pipe temperature detecting units 121 attached to the corresponding coupling pipes 134 may be used as the outlet temperature of the first heat exchange unit 112*a*.

The order control unit 152 has a function such that, if it is determined by the threshold determining unit 151 that the outlet temperature of the heat source-side heat exchanger 112 is higher than the threshold temperature, the order control unit 152 controls the order switching unit 140 to switch the order in which the heat medium flows through the first heat exchange unit 112*a* and the second heat exchange unit 112*b*. By way of specific example, the order in which the heat medium flows is switched by changing a state in which the first order-switching valve 143 and the second order-switching valve 144 are closed and the third order-switching valve 145 and the fourth order-switching valve 146 are open, to a state in which the first order-switching valve 143 and the second order-switching valve 144 are open and the third order-switching valve 145 and the fourth order-switching valve 146 are closed.

Next, heating operation, cooling operation, and defrosting operation of the air-conditioning apparatus 100 according to Embodiment 2 will be described.

First, heating operation will be described. The compressor 11 sucks and compresses a heat medium, and discharges the heat medium in a high-temperature, high-pressure gaseous state. The discharged heat medium passes through the flow switching unit 15, and enters the use-side heat exchanger 14. The use-side heat exchanger 14 causes the heat medium to be condensed through heat exchange with the indoor air. The condensed heat medium enters the expansion unit 13. The expansion unit 13 reduces the pressure of the condensed heat medium. Then, the heat medium that has been reduced in pressure passes through the fourth order-switching valve 146, and enters the second liquid header 133. In heating operation, the first order-switching valve 143 and the second order-switching valve 144 are closed, and the third order-switching valve 145 and the fourth order-switching valve 146 are open.

Then, the heat medium enters the second heat exchange unit 112*b* of the heat source-side heat exchanger 112 from the second liquid header 133, and then enters the first heat exchange unit 112*a* through the coupling pipes 134. The heat medium then enters the first gas header 131. At this time, the heat source-side heat exchanger 112 causes the heat medium to be evaporated through heat exchange with the outdoor air. The evaporated heat medium passes through the third order-switching valve 145, and reaches the flow switching unit 15. Then, the heat medium enters the accumulator 16, and is sucked into the compressor 11.

Next, cooling operation will be described. The compressor 11 sucks and compresses a heat medium, and discharges the heat medium in a high-temperature, high-pressure gaseous state. The discharged heat medium passes through the flow switching unit 15, and then also passes through the third order-switching valve 145 and enters the first gas header 131. In cooling operation as well, the first order-switching valve 143 and the second order-switching valve 144 are closed, and the third order-switching valve 145 and the fourth order-switching valve 146 are open. The heat medium routed into the first gas header 131 enters the first heat exchange unit 112*a* of the heat source-side heat exchanger 112, and then enters the second heat exchange unit 112*b* through the coupling pipes 134. Then, the heat medium enters the second liquid header 133. At this time, the heat source-side heat exchanger 112 causes the heat medium to be condensed through heat exchange with the outdoor air.

The condensed heat medium passes through the fourth order-switching valve 146, and enters the expansion unit 13. The expansion unit 13 reduces the pressure of the condensed heat medium. The heat medium that has been reduced in pressure then enters the use-side heat exchanger 14. The use-side heat exchanger 14 causes the heat medium to be evaporated through heat exchange with the indoor air. After the evaporated heat medium passes through the flow switching unit 15, the heat medium enters the accumulator 16, and is sucked into the compressor 11.

Next, defrosting operation will be described. First, a description will be given of a case in which the first order-switching valve 143 and the second order-switching valve 144 are closed, and the third order-switching valve 145 and the fourth order-switching valve 146 are open. The compressor 11 sucks and compresses a heat medium, and discharges the heat medium in a high-temperature, high-pressure gaseous state. The discharged heat medium passes through the flow switching unit 15, and then also passes through the third order-switching valve 145 and enters the first gas header 131. The heat medium routed into the first gas header 131 enters the first heat exchange unit 112*a* of the heat source-side heat exchanger 112, and then enters the second heat exchange unit 112*b* through the coupling pipes 134. Then, the heat medium enters the second liquid header 133. At this time, the heat source-side heat exchanger 112 causes the heat medium to be condensed through heat exchange with the outdoor air. The temperature of the heat medium routed through the second heat exchange unit 112*b* is roughly equal to the condensing temperature, for example, about 40 degrees C. Thus, in the second heat exchange unit 112*b*, the resulting quantity of heat is not sufficient for actively melting the frost deposited on the second heat exchange unit 112*b*.

The condensed heat medium passes through the fourth order-switching valve 146, and enters the expansion unit 13. The expansion unit 13 reduces the pressure of the condensed heat medium. The heat medium that has been reduced in pressure then enters the use-side heat exchanger 14. The use-side heat exchanger 14 causes the heat medium to be evaporated through heat exchange with the indoor air. After the evaporated heat medium passes through the flow switching unit 15, the heat medium enters the accumulator 16, and is sucked into the compressor 11.

Next, a description will be given of a case in which, during defrosting operation, the first order-switching valve 143 and the second order-switching valve 144 are open, and the third order-switching valve 145 and the fourth order-switching valve 146 are closed. The compressor 11 sucks and compresses a heat medium, and discharges the heat medium in a high-temperature, high-pressure gaseous state. The discharged heat medium passes through the flow switching unit 15. Then, the heat medium enters the first bypass pipe 141, and passes through the first order-switching valve 143. Then, the heat medium enters the second liquid header 133. The heat medium routed into the second liquid header 133 enters the second heat exchange unit 112*b* of the heat source-side heat exchanger 112, and then enters the first heat exchange unit 112*a* through the coupling pipes 134. Then, the heat medium enters the first gas header 131. At this time, the heat source-side heat exchanger 112 causes the heat medium to be condensed through heat exchange with the outdoor air.

The condensed heat medium enters the second bypass pipe 142, and passes through the second order-switching valve 144. Then, the heat medium enters the expansion unit 13. The expansion unit 13 reduces the pressure of the condensed heat medium. The heat medium that has been reduced in pressure then enters the use-side heat exchanger 14. The use-side heat exchanger 14 causes the heat medium to be evaporated through heat exchange with the indoor air. After the evaporated heat medium passes through the flow switching unit 15, the heat medium enters the accumulator 16, and is sucked into the compressor 11.

Figure 7:
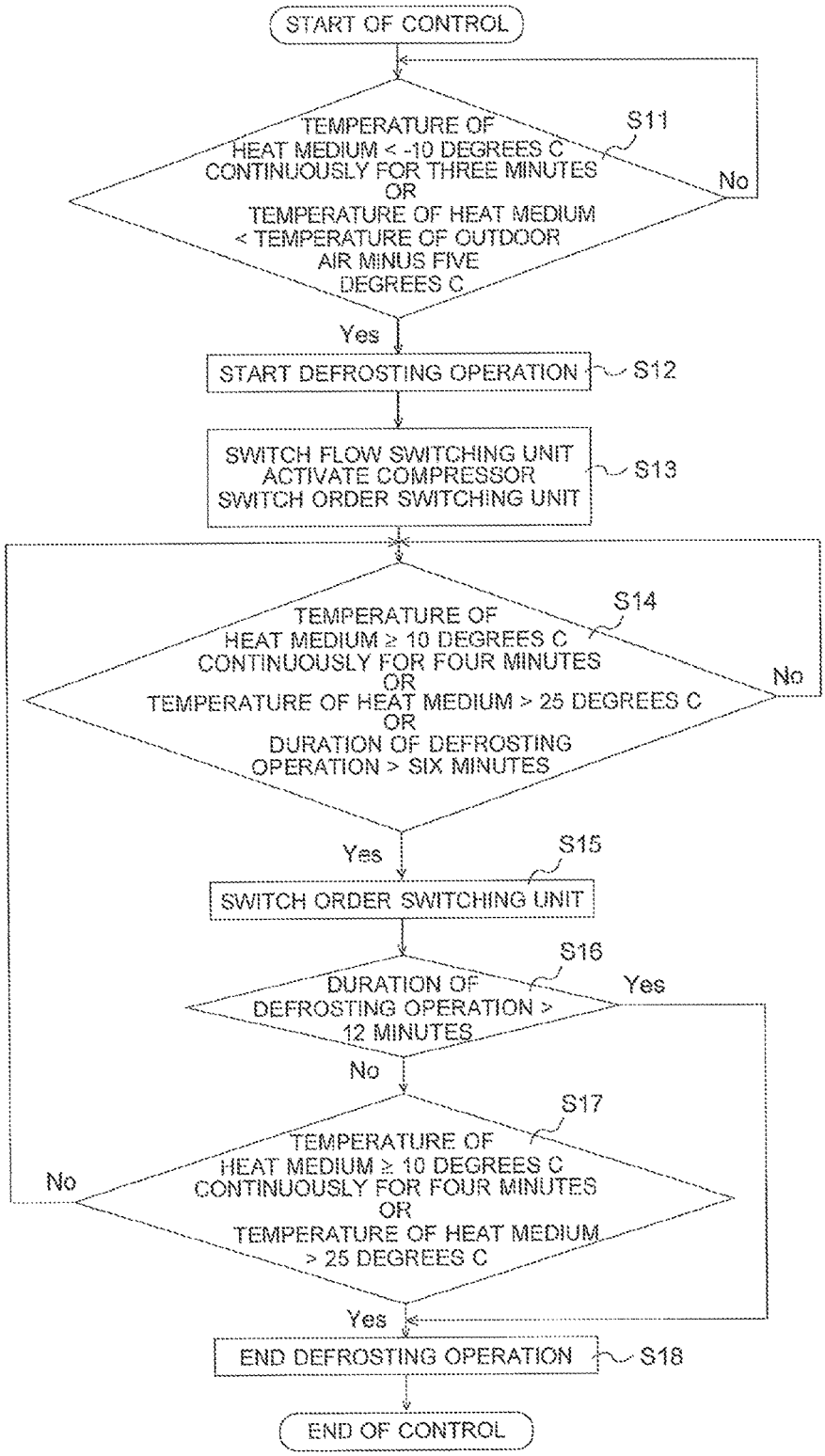
FIG. 7 is a flowchart for illustrating operation of the air-conditioning apparatus 100 according to Embodiment 2.

Next, operation of the air-conditioning apparatus 100 according to Embodiment 2 will be described. FIG. 7 is a flowchart for illustrating operation of the air-conditioning apparatus 100 according to Embodiment 2. As illustrated in FIG. 7, while heating operation is performed, the control unit 150 determines whether to perform defrosting operation (step S11).

For example, the defrosting operation is started if a predetermined temperature is detected by the heat medium temperature detecting unit 26 for a predetermined duration of time. In this case, the predetermined temperature is a fixed value of, for example, −10 degrees C., and the predetermined duration of time is, for example, three minutes. The defrosting operation may be started if the temperature of the heat medium detected by the heat medium temperature detecting unit 26 is lower than the temperature of the outdoor air detected by the outside-air temperature detecting unit 25 by a predetermined temperature. The predetermined temperature is, for example, five degrees C.

If the above-mentioned condition is not satisfied (step S11; No), step S11 is repeated. If the above-mentioned condition is satisfied (step S11; Yes), the defrosting operation is started (step S12). Then, the flow switching unit 15 is switched, operation of the compressor 11 is started, the first order-switching valve 143 and the second order-switching valve 144 are closed, and the third order-switching valve 145 and the fourth order-switching valve 146 are opened (step S13). As a result, the heat medium flows through the heat source-side heat exchanger 112 in the direction indicated by solid arrows in FIG. 5. The compressor 11 operates at a predetermined frequency. In this regard, the frequency of the compressor 11 may be determined based on the temperature of the heat medium detected by the heat medium temperature detecting unit 26.

Next, it is determined by the threshold determining unit 151 whether the outlet temperature of the first heat exchange unit 112*a* detected by the coupling-pipe temperature detecting unit 121 is higher than a predetermined threshold temperature (step S14). If it is determined that the outlet temperature of the first heat exchange unit 112*a* is lower than the threshold temperature (step S14; No), step S14 is repeated. If it is determined that the outlet temperature of the first heat exchange unit 112*a* is higher than the threshold temperature (step S14; Yes), the first order-switching valve 143 and the second order-switching valve 144 are opened, and the third order-switching valve 145 and the fourth order-switching valve 146 are closed (step S15). As a result, the heat medium flows through the heat source-side heat exchanger 112 in the direction indicated by broken arrows in FIG. 5. The processing then proceeds to step S16.

In step S14, the processing may proceed to step S15 if a predetermined temperature is detected by the coupling-pipe temperature detecting unit 121 for a predetermined duration of time. In this case, the predetermined temperature is, for example, 10 degrees C., and the predetermined duration of time is, for example, four minutes. Further, the processing may be forced to proceed to step S15 once a predetermined duration of time elapses. In this case, the predetermined duration of time is, for example, six minutes.

In step S16, it is determined by the control unit 150 whether a predetermined duration of defrosting operation has elapsed. In this case, the predetermined duration is, for example, 12 minutes. If 12 minutes have elapsed since the start of the defrosting operation (step S16; Yes), the processing proceeds to step S18. If 12 minutes have not elapsed since the start of the defrosting operation (step S16; No), the processing proceeds to the next step S17.

In step S17, it is determined whether the control unit 150 forces the defrosting operation to end even if 12 minutes have not elapsed since the start of the defrosting operation. For example, the defrosting operation is ended if a predetermined temperature is detected by the heat medium temperature detecting unit 26 for a predetermined duration of time. In this case, the predetermined temperature is, for example, 10 degrees C., and the predetermined duration of time is, for example, four minutes. The defrosting operation may be immediately ended if the temperature of the heat medium detected by the heat medium temperature detecting unit 26 exceeds a predetermined temperature. The predetermined temperature is, for example, 25 degrees C.

If the above-mentioned condition is not satisfied (step S17; No), the processing returns to step S14. If the above-mentioned condition is satisfied (step S17; Yes), the defrosting operation is ended (step S18).

As described above, in the air-conditioning apparatus 100 according to Embodiment 2, the first order-switching valve 143 and the second order-switching valve 144 are closed, and the third order-switching valve 145 and the fourth order-switching valve 146 are opened in step S13. As a result, the heat medium flows through the heat source-side heat exchanger 112 in the direction indicated by solid arrows in FIG. 5. Thus, the high-temperature, high-pressure heat medium discharged from the compressor 11 first enters the first heat exchange unit 112*a* of the heat source-side heat exchanger 112. In heating operation, the greatest temperature drop occurs in the branch pipes and the first gas header 131 into which a gaseous heat medium flows out from the first heat exchange unit 112*a*. In this way, the heat medium is routed into the first heat exchange unit 112*a* where the greatest temperature drop occurs, thus preventing frost from remaining unmelted on the first heat exchange unit 112*a*.

However, as described above, the quantity of heat in the second heat exchange unit 112*b* is not sufficient for actively melting the frost deposited on the second heat exchange unit 112*b*. In Embodiment 2, the first order-switching valve 143 and the second order-switching valve 144 are opened, and the third order-switching valve 145 and the fourth order-switching valve 146 are closed in step S15. As a result, the heat medium flows through the heat source-side heat exchanger 112 in the direction indicated by broken arrows in FIG. 5. As a result, the high-temperature, high-pressure heat medium discharged from the compressor 11 flows not into the first heat exchange unit 112*a* but directly into the second heat exchange unit 112*b*. In this way, the heat medium is actively routed into the second heat exchange unit 112*b*. Thus, in the second heat exchange unit 112*b*, frost is melted, thus preventing the frost from remaining unmelted. In this way, Embodiment 2 also enables improved defrosting capacity throughout the entire heat source-side heat exchanger 112.

Embodiment 3

Figure 8:
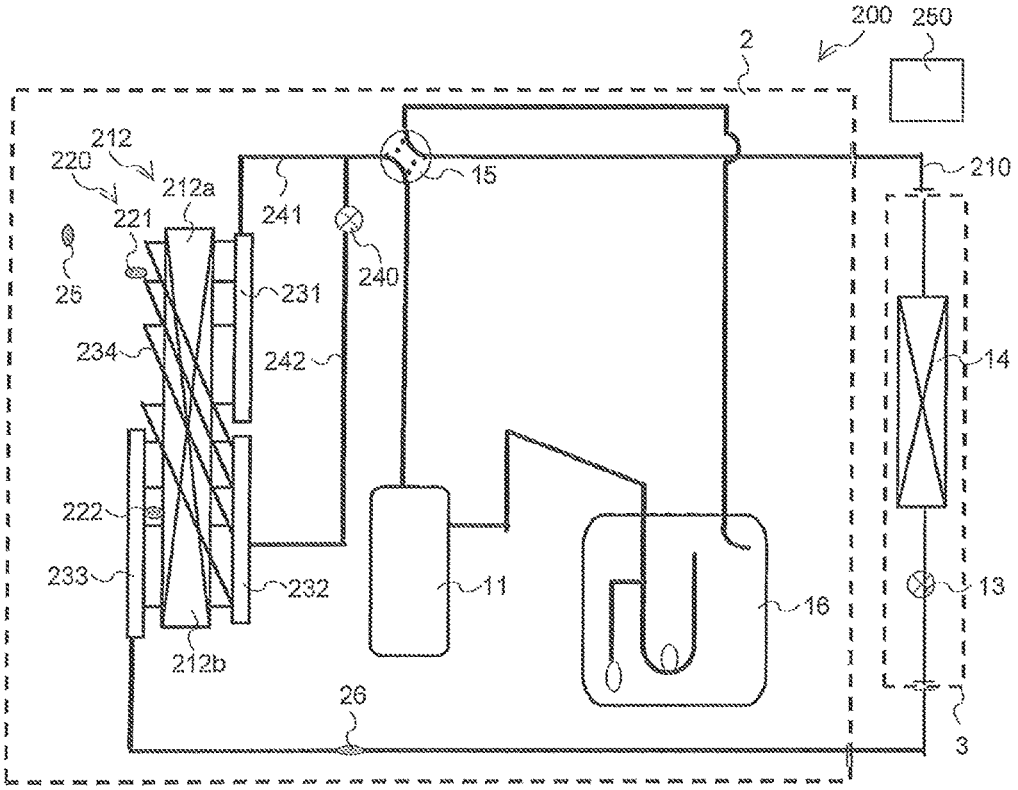
FIG. 8 is a circuit diagram for illustrating an air-conditioning apparatus 200 according to Embodiment 3.

Next, operation of an air-conditioning apparatus 200 according to Embodiment 3 will be described. FIG. 8 is a circuit diagram for illustrating the air-conditioning apparatus 200 according to Embodiment 3. As illustrated in FIG. 8, Embodiment 3 differs from Embodiment 1 in the configuration of a heat source-side heat exchanger 212, and the locations where a first temperature detecting unit 221, a second temperature detecting unit 222, and a flow regulating unit 240 are installed. In Embodiment 3, portions that are the same as those in Embodiment 1 are denoted by the identical reference signs to avoid repetitive description, and the description mainly focuses on differences from Embodiments 1 and 2.

The heat source-side heat exchanger 212 includes a coupling pipe 234. The coupling pipe 234 connects the outlet side of a first heat exchange unit 212*a* with the inlet side of a second heat exchange unit 212*b*. Thus, the first heat exchange unit 212*a* and the second heat exchange unit 212*b* are connected in series in the heat source-side heat exchanger 212. In Embodiment 3, a plurality of coupling pipes 234 are provided. The side of the first heat exchange unit 212*a* where a liquid heat medium exits and the side of the second heat exchange unit 212*b* where a liquid heat medium enters are connected by the plurality of coupling pipes 234.

A first gas header 231 is provided on the inflow side of a gaseous heat medium with respect to the first heat exchange unit 212*a*. The first gas header 231 and the first heat exchange unit 212*a* are connected by a plurality of branch pipes. Further, a second liquid header 233 is provided on the outflow side of a liquid heat medium with respect to the second heat exchange unit 212*b*. The second liquid header 233 and the second heat exchange unit 212*b* are also connected by a plurality of branch pipes. Furthermore, a second gas header 232 is provided on the inflow side of a liquid heat medium with respect to the second heat exchange unit 212*b*. The second gas header 232 and the second heat exchange unit 212*b* are also connected by a plurality of branch pipes.

In Embodiment 3, the second liquid header 233 is used to merge the flows of heat medium exiting the second heat exchange unit 212*b*. Alternatively, as in Embodiment 1, capillary tubes and a distributor may be used to merge the flows of heat medium exiting the second heat exchange unit 212*b*.

A temperature detecting unit 220 detects the outlet temperature of the heat source-side heat exchanger 212. The temperature detecting unit 220 includes the first temperature detecting unit 221, and the second temperature detecting unit 222. The first temperature detecting unit 221 is attached near the first heat exchange unit 212*a*, at a position on one coupling pipe 234 that couples the first heat exchange unit 212*a* and the second heat exchange unit 212*b* of the heat source-side heat exchanger 212. The first temperature detecting unit 221 detects the outlet temperature of the first heat exchange unit 212*a*. The second temperature detecting unit 222 is attached to one branch pipe that connects the second heat exchange unit 212*b* of the heat source-side heat exchanger 212 and the second gas header 232. The second temperature detecting unit 222 detects the outlet temperature of the second heat exchange unit 212*b*.

Although only one first temperature detecting unit 221 is attached to one coupling pipe 234 in Embodiment 3, the first temperature detecting unit 221 may be attached to a plurality of coupling pipes 234. If only one first temperature detecting unit 221 is to be attached as in Embodiment 3, preferably, the coupling pipe 234 subjected to the greatest drop in temperature during defrosting operation is selected as the coupling pipe 234 to which the first temperature detecting unit 221 is attached.

For example, the length of each individual coupling pipe 234 that couples the first heat exchange unit 212*a* and the second heat exchange unit 212*b* may be varied depending on its location. The shorter the coupling pipe 234, the greater the flow rate of heat medium through the coupling pipe 234, leading to increased frost deposition during heating operation. Attaching the first temperature detecting unit 221 to the coupling pipe 234 that is shorter than the other coupling pipes 234 in this way makes it possible to detect the temperature of the coupling pipe 234 that has dropped in temperature owing to the increased frost deposition. As for the length of each individual coupling pipe 234, only the coupling pipe 234 to which the first temperature detecting unit 221 is attached may be reduced in length, or the coupling pipes 234 other than the coupling pipe 234 to which the first temperature detecting unit 221 is attached may be increased in length.

In Embodiment 3, although only one second temperature detecting unit 222 is attached to one branch pipe connecting the second heat exchange unit 212*b* and the second gas header 232, the second temperature detecting unit 222 may be attached to a plurality of branch pipes. If only one second temperature detecting unit 222 is to be attached as in Embodiment 3, preferably, the branch pipe subjected to the greatest drop in temperature during defrosting operation is selected as the branch pipe to which the second temperature detecting unit 222 is attached.

If capillary tubes and a distributor are used to merge the flows of heat medium exiting the second heat exchange unit 212*b*, the length of each individual capillary tube that couples the distributor and the heat source-side heat exchanger 212 may be varied depending on its location. The shorter the capillary tube, the greater the flow rate of heat medium through the capillary tube, leading to increased frost deposition during heating operation. Attaching the second temperature detecting unit 222 to the capillary tube that is shorter than the other capillary tubes makes it possible to detect the temperature of the capillary tube that has dropped in temperature owing to the increased frost deposition.

Although a heat medium circuit 210 includes the flow regulating unit 240 as in Embodiment 1, the flow regulating unit 240 is installed in a location different from that in Embodiment 1. The flow regulating unit 240 regulates the flow rate of the heat medium routed through each of the first heat exchange unit 212*a* and the second heat exchange unit 212*b*. The flow regulating unit 240 is installed in a second connecting pipe 242 that connects the flow switching unit 15 and the second gas header 232. The opening degree of the flow regulating unit 240 is adjusted to regulate the flow rate of the heat medium routed through the second connecting pipe 242.

Once the flow regulating unit 240 is fully closed, there is no longer any flow of heat medium through the second connecting pipe 242, and the heat medium flows through only a first connecting pipe 241. Thus, after passing through the flow switching unit 15, the heat medium first enters only the first heat exchange unit 212*a*, and then enters the second heat exchange unit 212*b* through the coupling pipes LA. Thus, the flow rate of the heat medium routed through the first heat exchange unit 212*a* and the flow rate of the heat medium routed through the second heat exchange unit 212*b* become equal.

Then, as the flow regulating unit 240 is progressively opened, the flow rate of the heat medium routed through the second connecting pipe 242 increases, and the flow rate of the heat medium directly entering the second heat exchange unit 212*b* increases. Then, once the flow regulating unit 240 is fully opened, the flow rate of the heat medium routed through the first connecting pipe 241 and the flow rate of the heat medium routed through the second connecting pipe 242 become equal. Thus, the flow rate of the heat medium entering the second heat exchange unit 212*b* becomes greater than the flow rate of the heat medium entering the first heat exchange unit 212*a*, by an amount corresponding to the flow rate of the heat medium directly entering the second heat exchange unit 212*b*.

Figure 9:
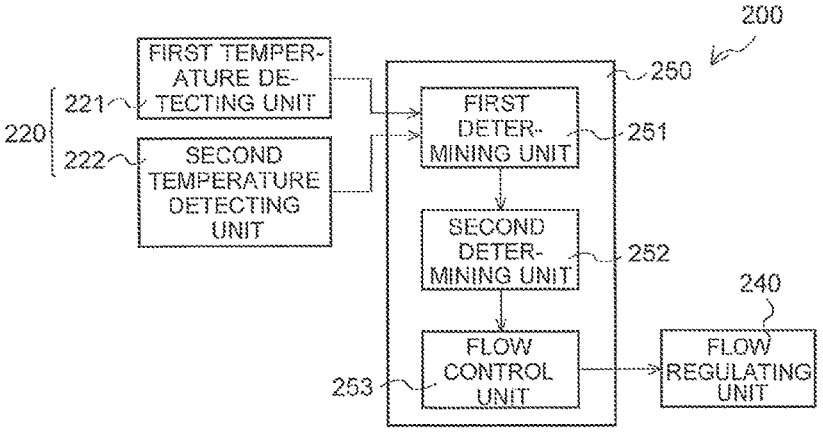
FIG. 9 is a block diagram for illustrating a control unit 250 according to Embodiment 3.

A control unit 250 controls the behavior of the heat medium in such a way that during defrosting operation, the frost deposited on the first heat exchange unit 212*a* and the second heat exchange unit 212*b* is removed based on the outlet temperature of the heat source-side heat exchanger 212 detected by the temperature detecting unit 220. FIG. 9 is a block diagram for illustrating the control unit 250 according to Embodiment 3. As illustrated in FIG. 9, the control unit 250 includes a first determining unit 251, a second determining unit 252, and a flow control unit 253.

The first determining unit 251 determines, during defrosting operation, whether the absolute value of the difference between the outlet temperature of the first heat exchange unit 212*a* detected by the first temperature detecting unit 221, and the outlet temperature of the second heat exchange unit 212*b* detected by the second temperature detecting unit 222 is greater than a predetermined differential temperature threshold. The differential temperature threshold is, for example, one degree C.

The second determining unit 252 determines, if it is determined by the first determining unit 251 that the difference is greater than the differential temperature threshold, whether the outlet temperature of the first heat exchange unit 212*a* detected by the first temperature detecting unit 221 is higher than the outlet temperature of the second heat exchange unit 212*b* detected by the second temperature detecting unit 222. As described above, the first temperature detecting unit 221 may be attached to a plurality of coupling pipes 234. In this case, the mean value of a plurality of outlet temperatures of the first heat exchange unit 212*a* detected by a plurality of first temperature detecting units 221 attached to the corresponding coupling pipes 234 may be used as the outlet temperature of the first heat exchange unit 212*a*.

The second temperature detecting unit 222 may be attached to a plurality of branch pipes connecting the second heat exchange unit 212*b* and the second gas header 232. In this case, the mean value of a plurality of outlet temperatures of the second heat exchange unit 212*b* detected by a plurality of second temperature detecting units 222 attached to the corresponding branch pipes may be used as the outlet temperature of the second heat exchange unit 212*b*. If capillary tubes and a distributor are used to merge the flows of heat medium exiting the second heat exchange unit 212*b*, the second temperature detecting unit 222 may be attached to a plurality of capillary tubes. In this case, the mean value of a plurality of outlet temperatures of the second heat exchange unit 212*b* detected by a plurality of second temperature detecting units 222 attached to the corresponding capillary tubes may be used as the outlet temperature of the second heat exchange unit 212*b*.

Further, if it is determined by the second determining unit 252 that the outlet temperature of the first heat exchange unit 212*a* is higher than the outlet temperature of the second heat exchange unit 212*b*, the flow control unit 253 controls the flow regulating unit 240 to reduce the flow rate of the heat medium routed through the first heat exchange unit 212*a*.

Next, heating operation, cooling operation, and defrosting operation of the air-conditioning apparatus 200 according to Embodiment 3 will be described.

First, heating operation will be described. The compressor 11 sucks and compresses a heat medium, and discharges the heat medium in a high-temperature, high-pressure gaseous state. The discharged heat medium passes through the flow switching unit 15, and enters the use-side heat exchanger 14. The use-side heat exchanger 14 causes the heat medium to be condensed through heat exchange with the indoor air. The condensed heat medium enters the expansion unit 13. The expansion unit 13 reduces the pressure of the condensed heat medium. Then, the heat medium that has been reduced in pressure enters the second liquid header 233.

Then, the heat medium enters the second heat exchange unit 212*b* of the heat source-side heat exchanger 212 from the second liquid header 233, and then reaches the second gas header 232. Then, the heat medium enters the first heat exchange unit 212*a* through the coupling pipes 234. In heating operation, the flow regulating unit 240 is fully closed. The heat medium then enters the first gas header 231. At this time, the heat source-side heat exchanger 212 causes the heat medium to be evaporated through heat exchange with the outdoor air. The evaporated heat medium flows through the first connecting pipe 241, and reaches the flow switching unit 15. Then, the heat medium enters the accumulator 16, and is sucked into the compressor 11.

Next, cooling operation will be described. The compressor 11 sucks and compresses a heat medium, and discharges the heat medium in a high-temperature, high-pressure gaseous state. The discharged heat medium passes through the flow switching unit 15, and then flows through the first connecting pipe 241. In cooling operation as well, the flow regulating unit 240 is fully closed. Then, the heat medium routed into the first connecting pipe 241 enters the first gas header 231, and then enters the first heat exchange unit 212*a* of the heat source-side heat exchanger 212. Then, the heat medium enters the second gas header 232 through the coupling pipes 234. Then, the heat medium enters the second heat exchange unit 212*b*, and enters the second liquid header 233. At this time, the heat source-side heat exchanger 212 causes the heat medium to be condensed through heat exchange with the outdoor air.

Then, the condensed heat medium enters the expansion unit 13. The expansion unit 13 reduces the pressure of the condensed heat medium. The heat medium that has been reduced in pressure then enters the use-side heat exchanger 14. The use-side heat exchanger 14 causes the heat medium to be evaporated through heat exchange with the indoor air. After the evaporated heat medium passes through the flow switching unit 15, the heat medium enters the accumulator 16, and is sucked into the compressor 11.

Next, defrosting operation will be described. The compressor 11 sucks and compresses a heat medium, and discharges the heat medium in a high-temperature, high-pressure gaseous state. In defrosting operation, the opening degree of the flow regulating unit 240 is changed as appropriate. When the flow regulating unit 240 is fully closed, the discharged heat medium passes through the flow switching unit 15, and then flows through the first connecting pipe 241. Then, the heat medium routed into the first connecting pipe 241 enters the first gas header 231, and then enters the first heat exchange unit 212*a* of the heat source-side heat exchanger 212. Then, the heat medium enters the second gas header 232 through the coupling pipes 234. Then, the heat medium enters the second heat exchange unit 212*b*, and enters the second liquid header 233. At this time, the heat source-side heat exchanger 212 causes the heat medium to be condensed through heat exchange with the outdoor air.

When the flow regulating unit 240 is open, the discharged heat medium passes through the flow switching unit 15, and then branches into the first connecting pipe 241 and the second connecting pipe 242. Then, the heat medium routed into the first connecting pipe 241 enters the first gas header 231, and then enters the first heat exchange unit 212*a* of the heat source-side heat exchanger 212. Then, the heat medium enters the second gas header 232 through the coupling pipes 234. Then, the heat medium enters the second heat exchange unit 212*b*, and enters the second liquid header 233.

On the other hand, the heat medium routed into the second connecting pipe 242 enters the second gas header 232, and then enters the second heat exchange unit 212*b* of the heat source-side heat exchanger 212 without passing through the first heat exchange unit 212*a*. Then, the heat medium enters the second liquid header 233. That is, the branched flows of heat medium routed through the first connecting pipe 241 and the second connecting pipe 242 merge at the second gas header 232. At this time, the heat source-side heat exchanger 212 causes the heat medium to be condensed through heat exchange with the outdoor air.

Then, the condensed heat medium enters the expansion unit 13. The expansion unit 13 reduces the pressure of the condensed heat medium. The heat medium that has been reduced in pressure then enters the use-side heat exchanger 14. The use-side heat exchanger 14 causes the heat medium to be evaporated through heat exchange with the indoor air. After the evaporated heat medium passes through the flow switching unit 15, the heat medium enters the accumulator 16, and is sucked into the compressor 11.

Figure 10:
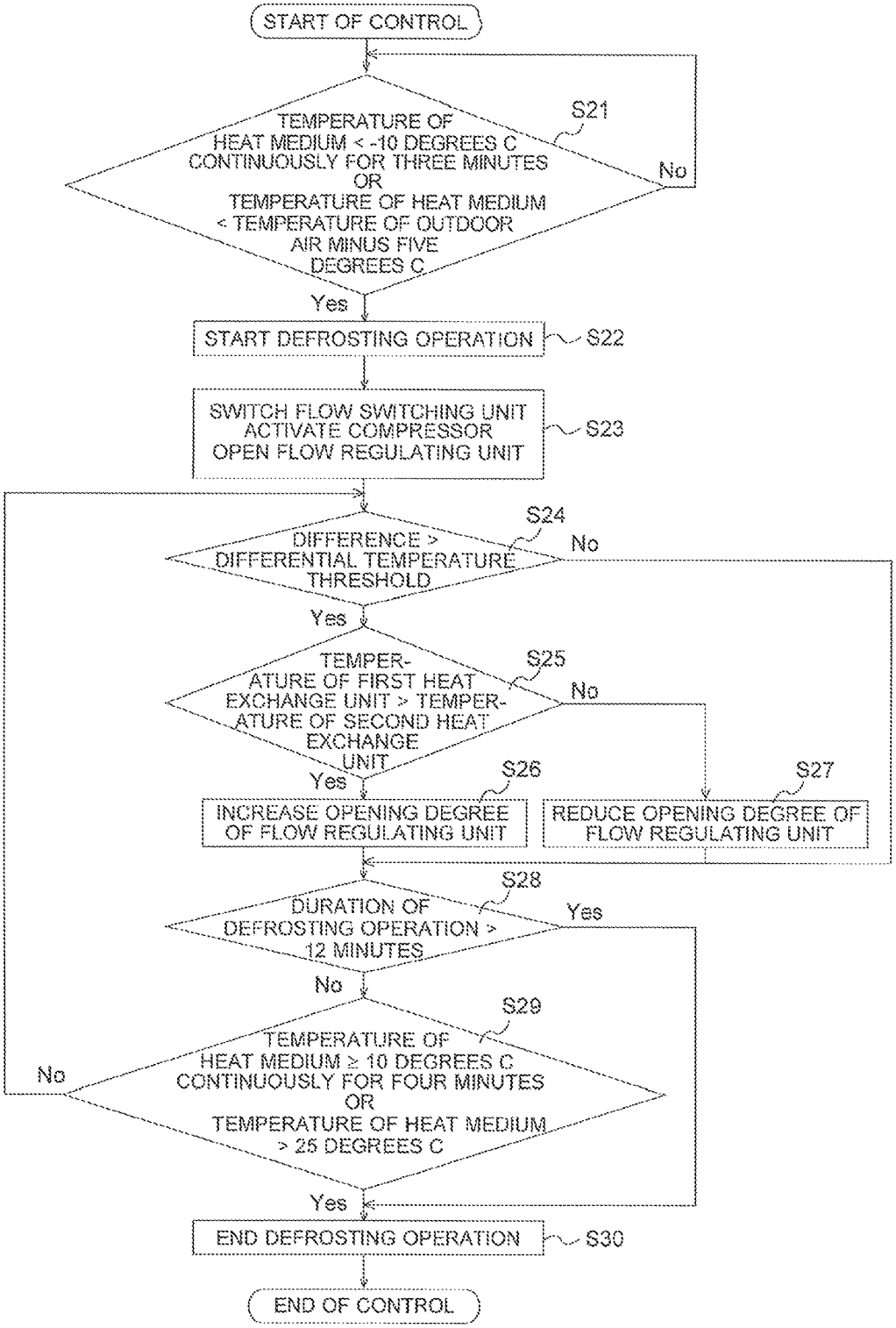
FIG. 10 is a flowchart for illustrating operation of the air-conditioning apparatus 200 according to Embodiment 3.

Next, operation of the air-conditioning apparatus 200 according to Embodiment 3 will be described. FIG. 10 is a flowchart for illustrating operation of the air-conditioning apparatus 200 according to Embodiment 1. As illustrated in FIG. 10, while heating operation is performed, the control unit 250 determines whether to perform defrosting operation (step S21).

For example, the defrosting operation is started if a predetermined temperature is detected by the heat medium temperature detecting unit 26 for a predetermined duration of time. In this case, the predetermined temperature is a fixed value of, for example, −10 degrees C., and the predetermined duration of time is, for example, three minutes. The defrosting operation may be started if the temperature of the heat medium detected by the heat medium temperature detecting unit 26 is lower than the temperature of the outdoor air detected by the outside-air temperature detecting unit 25 by a predetermined temperature. The predetermined temperature is, for example, five degrees C.

If the above-mentioned condition is not satisfied (step S21; No), step S21 is repeated. If the above-mentioned condition is satisfied (step S21; Yes), the defrosting operation is started (step S22). Then, the flow switching unit 15 is switched, operation of the compressor 11 is started, and the flow regulating unit 240 is opened to a predetermined opening degree (step S23). The compressor 11 operates at a predetermined frequency. In this regard, the frequency of the compressor 11 may be determined based on the temperature of the heat medium detected by the heat medium temperature detecting unit 26, the temperature of the first heat exchange unit 212*a* detected by the first temperature detecting unit 221, or the temperature of the second heat exchange unit 212*b* detected by the second temperature detecting unit 222.

Next, it is determined by the first determining unit 251 whether the absolute value of the difference between the outlet temperature of the first heat exchange unit 212*a* detected by the first temperature detecting unit 221, and the outlet temperature of the second heat exchange unit 212*b* detected by the second temperature detecting unit 222 is greater than a predetermined differential temperature threshold (step S24). If it is determined that the difference is less than the differential temperature threshold (step S24; No), the opening degree of the flow regulating unit 240 is not adjusted, and the processing proceeds to step S28.

If the outlet temperature of the first heat exchange unit 212*a* and the outlet temperature of the second heat exchange unit 212*b* are close to each other, the growth of frost on the first heat exchange unit 212*a* and the growth of frost on the second heat exchange unit 212*b* are regarded as substantially equal, and thus the flow regulating unit 240 is maintained at a predetermined opening degree. If it is determined that the difference is greater than the differential temperature threshold (step S24; Yes), the processing proceeds to the next step S25.

In step S25, it is determined by the second determining unit 252 whether the outlet temperature of the first heat exchange unit 212*a* detected by the first temperature detecting unit 221 is higher than the outlet temperature of the second heat exchange unit 212*b* detected by the second temperature detecting unit 222. If the outlet temperature of the first heat exchange unit 212*a* is higher than the outlet temperature of the second heat exchange unit 212*b* (step S25; Yes), the opening degree of the flow regulating unit 240 is increased by the flow control unit 253 (step S26). As a result, the flow rate of the heat medium entering the first heat exchange unit 212*a* is reduced by an amount corresponding to an increase in the flow rate of the heat medium directly entering the second heat exchange unit 212*b*. The processing then proceeds to step S28.

By contrast, if the outlet temperature of the first heat exchange unit 212*a* is lower than the outlet temperature of the second heat exchange unit 212*b* (step S25; No), the opening degree of the flow regulating unit 240 is reduced by the flow control unit 253 (step S27). As a result, the flow rate of the heat medium entering the first heat exchange unit 212*a* is increased by an amount corresponding to a decrease in the flow rate of the heat medium directly entering the second heat exchange unit 212*b*. The processing then proceeds to step S28.

In step S28, it is determined by the control unit 250 whether a predetermined duration of defrosting operation has elapsed. In this case, the predetermined duration is, for example, 12 minutes. If 12 minutes have elapsed since the start of the defrosting operation (step S28; Yes), the processing proceeds to step S30. If 12 minutes have not elapsed since the start of the defrosting operation (step S28; No), the processing proceeds to the next step S29.

In step S29, it is determined whether the control unit 250 forces the defrosting operation to end even if 12 minutes have not elapsed since the start of the defrosting operation. For example, the defrosting operation is ended if a predetermined temperature is detected by the heat medium temperature detecting unit 26 for a predetermined duration of time. In this case, the predetermined temperature is, for example, 10 degrees C., and the predetermined duration of time is, for example, four minutes. The defrosting operation may be immediately ended if the temperature of the heat medium detected by the heat medium temperature detecting unit 26 exceeds a predetermined temperature. The predetermined temperature is, for example, 25 degrees C.

If the above-mentioned condition is not satisfied (step S29; No), the processing returns to step S24. If the above-mentioned condition is satisfied (step S29; Yes), the defrosting operation is ended (step S30).

As described above, in the air-conditioning apparatus 200 according to Embodiment 3, if it is determined by the second determining unit 252 that the outlet temperature of the first heat exchange unit 212*a* is higher than the outlet temperature of the second heat exchange unit 212*b*, the flow control unit 253 controls the flow regulating unit 240 to reduce the flow rate of the heat medium routed through the first heat exchange unit 212*a*. This allows defrosting capacity to be made uniform throughout the entire heat source-side heat exchanger 212.

Further, in Embodiment 3, if the difference is greater than the differential temperature threshold, and the outlet temperature of the first heat exchange unit 212*a* is higher than the outlet temperature of the second heat exchange unit 212*b*, this leads to a significant growth of the frost deposited on the second heat exchange unit 212*b*. As a result, the amount of heat that needs to be rejected to melt this frost increases. Thus, the outlet temperature of the second heat exchange unit 212*b* is determined to be low. Accordingly, the opening degree of the flow regulating unit 240 is increased, thus increasing the flow rate of the heat medium directly routed into the second heat exchange unit 212*b*. This allows for more heat rejection in the second heat exchange unit 212*b*, thus facilitating melting of frost. This prevents frost from remaining unmelted.

Further, in Embodiment 3, if the difference is greater than the differential temperature threshold, and the outlet temperature of the first heat exchange unit 212*a* is lower than the outlet temperature of the second heat exchange unit 212*b*, it is determined that an excessive heat medium is flowing into the second heat exchange unit 212*b*. Accordingly, the opening degree of the flow regulating unit 240 is reduced, thus reducing the flow rate of the heat medium directly routed into the second heat exchange unit 212*b*. This prevents an excessive heat medium from being routed through the second heat exchange unit 212*b*, thus enabling uniform defrosting of the first heat exchange unit 212*a* and the second heat exchange unit 212*b*.

In Embodiments 1 to 3 mentioned above, the first heat exchange unit may be located in an upper part of the heat source-side heat exchanger, and the second heat exchange unit may be located in a lower part of the heat source-side heat exchanger. In this case, even as an ice block begins to form over the area from the first heat exchange unit to the second heat exchange unit, the ability to uniformly defrost the first heat exchange unit and the second heat exchange unit allows formation of such an ice block to be reduced.

Further, the air-conditioning apparatus may be designed to include both the flow regulating unit 40 according to Embodiment 1, and the flow regulating unit 240 according to Embodiment 3.

REFERENCE SIGNS LIST

1 air-conditioning apparatus 2 outdoor unit indoor unit 4 building 5 outdoor space 6 indoor space 10 heat medium circuit 11 compressor 12 heat source-side heat exchanger 12*a* first heat exchange unit 12*b* second heat exchange unit 13 expansion unit 14 use-side heat exchanger 15 flow switching unit 16 accumulator 20 temperature detecting unit 21 first temperature detecting unit 22 second temperature detecting unit 25 outside-air temperature detecting unit 26 heat medium temperature detecting unit 31 first gas header 32 second gas header 34 capillary tube 35 distributor 40 flow regulating unit 41 first connecting pipe 42 second connecting pipe 50 control unit 51 first determining unit second determining unit 53 flow control unit 100 air-conditioning apparatus 110 heat medium circuit 112 heat source-side heat exchanger 112*a* first heat exchange unit 112*b* second heat exchange unit 120 temperature detecting unit 121 coupling-pipe temperature detecting unit 131 first gas header 133 second liquid header 134 coupling pipe 140 order switching unit 141 first bypass pipe 142 second bypass pipe 143 first order-switching valve 144 second order-switching valve 145 third order-switching valve 146 fourth order-switching valve 150 control unit 151 threshold determining unit 152 order control unit 200 air-conditioning apparatus 210 heat medium circuit 212 heat source-side heat exchanger 212*a* first heat exchange unit 212*b* second heat exchange unit 220 temperature detecting unit 221 first temperature detecting unit 222 second temperature detecting unit 231 first gas header 232 second gas header 233 second liquid header 234 coupling pipe 240 flow regulating unit 241 first connecting pipe 242 second connecting pipe 250 control unit 251 first determining unit 252 second determining unit 253 flow control unit

The invention claimed is:

1. An air-conditioning apparatus comprising a heat medium circuit in which a compressor, a flow switching unit, a flow regulating unit, at least one gas header, a heat source-side heat exchanger including a first heat exchange unit and a second heat exchange unit, a distributor, an expansion unit, and a use-side heat exchanger are connected by pipes, and during a defrosting operation to defrost the heat source-side heat exchanger, heat medium circulates, in order, from the compressor, to the flow switching unit, the at least one gas header, the heat source-side heat exchangers, the distributor, the expansion unit, and the use-side heat exchanger, wherein the second heat exchange unit is provided lower than the first heat exchange unit, the flow regulating unit is configured, during the defrosting operation, to regulate a flow rate of heat medium flowing through the first heat exchange unit and a flow rate of heat medium flowing through the second heat exchange unit, the heat medium circuit is configured by connecting an outdoor unit, which is installed at an outdoor space and which houses the compressor, the flow switching unit, the flow regulating unit, the at least one gas header, the heat source-side heat exchanger, and the distributor, to an indoor unit, which is installed at an indoor space and which houses the expansion unit and the use-side heat exchanger, and the air-conditioning apparatus further comprises:

a heat medium temperature detecting unit configured to detect a temperature of heat medium at a location between the distributor and the indoor unit; and a controller configured to switch a heating operation for heating the indoor space to the defrosting operation based on the temperature of the heat medium detected by the heat medium temperature detecting unit.

2. The air-conditioning apparatus of claim 1, wherein the at least one gas header comprises a first gas header connected to the first heat exchange unit, and a second gas header connected to the second heat exchange unit, and a number of pipes connecting the first gas header and the first heat exchange unit is greater than a number of pipes connecting the second gas header and the second heat exchange unit.

3. The air-conditioning apparatus of claim 2, further comprising:

a first connecting pipe connecting the first gas header and the flow switching unit, wherein the flow regulating unit is provided in the first connecting pipe; and a second connecting pipe connecting the second gas header and the flow switching unit.

4. The air-conditioning apparatus of claim 1, further comprising an outside-air temperature detecting unit configured to detect a temperature of outdoor air, wherein the controller is configured to switch the heating operation to the defrosting operation if the temperature of the heat medium detected by the heat medium temperature detecting unit is lower than the temperature of the outdoor air detected by the outside-air temperature detecting unit by a predetermined temperature.

5. The air-conditioning apparatus of claim 1, further comprising:

a first temperature detecting unit configured to, during the defrosting operation, detect a temperature of the heat medium that has flowed out from the first heat exchange unit; and a second temperature detecting unit configured to, during the defrosting operation, detect a temperature of the heat medium that has flowed out from the second heat exchange unit.

6. The air-conditioning apparatus of claim 5, wherein the first temperature detecting unit is attached to one of a plurality of capillary tubes connecting the first heat exchange unit and the distributor, and the one of the plurality of capillary tubes connecting the first heat exchange unit and the distributor is shorter than other of the plurality of capillary tubes connecting the first heat exchange unit and the distributor, and the second temperature detecting unit is attached to one of a plurality of capillary tubes connecting the second heat exchange unit and the distributor, and the one of the plurality of capillary tubes connecting the second heat exchange unit and the distributor is shorter than other of the plurality of capillary tubes connecting the second heat exchange unit and the distributor.

7. The air-conditioning apparatus of claim 5, further comprising a controller configured to adjust an opening degree of the flow regulating unit so that the temperature of the heat medium detected by the first temperature detecting unit and the temperature of the heat medium detected by the second temperature detecting unit become close to each other.

* * * * *